US008727469B2

(12) United States Patent
Hattori et al.

(10) Patent No.: US 8,727,469 B2
(45) Date of Patent: May 20, 2014

(54) IMAGE FORMING APPARATUS

(75) Inventors: Kazumasa Hattori, Kanagawa (JP); Yutaka Korogi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 164 days.

(21) Appl. No.: 13/402,841

(22) Filed: Feb. 22, 2012

(65) Prior Publication Data

US 2012/0218328 A1 Aug. 30, 2012

(30) Foreign Application Priority Data

Feb. 25, 2011 (JP) ..... 2011-040702

(51) Int. Cl.
*B41J 25/308* (2006.01)

(52) U.S. Cl.
USPC ..... 347/8; 347/19; 347/17

(58) Field of Classification Search
USPC ..... 347/5, 8, 9, 17, 19
IPC ..... B41J 11/20,25/308
See application file for complete search history.

(56) References Cited

U.S. PATENT DOCUMENTS 6,666,537 B1 * 12/2003 Kelley et al. ..... 347/8
7,044,575 B2 * 5/2006 Kelley et al. ..... 347/19
2004/0233244 A1 * 11/2004 Elgee et al. ..... 347/19

FOREIGN PATENT DOCUMENTS

JP 2010-76872 A 4/2010

OTHER PUBLICATIONS

Chinese Office Action dated Dec. 23, 2013 which was issued for the corresponding Chinese Patent Application No. 201210042891.8.

* cited by examiner

*Primary Examiner* — Lam S Nguyen
(74) *Attorney, Agent, or Firm* — SOLARIS Intellectual Property Group, PLLC

(57) ABSTRACT

An image forming apparatus comprising: a conveying unit; a liquid droplet jetting head that jets liquid droplets onto a recording medium conveyed by the conveying unit; an uplift amount detection unit that is provided at the recording medium conveying direction upstream side of the liquid droplet jetting head, projects and receives light along the conveying unit, and detects an uplift amount of the recording medium; a control unit that lowers the conveying speed of the conveying unit or separates the liquid droplet jetting head from the conveying unit when the uplift amount detected is a threshold value or greater; a temperature detection unit that detects temperatures; and a correcting unit that corrects the threshold value or the uplift amount based on the temperature difference between a temperature detected at the periphery of the uplift amount detection unit and a temperature detected at the periphery of the liquid droplet jetting heads.

7 Claims, 10 Drawing Sheets

IMAGE FORMING APPARATUS

CROSS-REFERENCE TO RELATED APPLICATION

This application is claims priority under 35 USC 119 from Japanese Patent Application No. 2011-040702 filed on Feb. 25, 2011, the disclosure of which is incorporated by reference herein. Japanese Patent Application No. 2012-029959, filed on Feb. 14, 2012, is incorporated herein by reference.

BACKGROUND OF THE INVENTION

1. Technical Field

The present invention relates to an image forming apparatus.

2. Related Art

An image forming apparatus is already known that has liquid droplet jetting heads arrayed with plural nozzles, and employing liquid droplet jetting recording to form an image (including text) on a recording medium by relatively conveying the recording medium with respect to the liquid droplet jetting heads, and jetting liquid droplets, such as ink, from the nozzles towards the recording medium.

In such a liquid droplet recording-method image forming apparatus, since the nozzle faces of the liquid droplet jetting heads is brought into close proximity to the recording medium to jet the liquid droplets, sometimes, depending on the shape of the recording medium, the recording medium makes contact with the nozzles, resulting in dirt adhering to the recording medium, and/or causing scratching of the nozzle face, or generating other problems such as paper dust becoming clogged in the nozzles or irregular jetting.

To address such problems, an image forming apparatus described in Japanese Patent Application Laid-Open (JP-A) No. 2010-76872 includes an uplift amount detection unit that projects a beam of light along the width direction of the recording medium being conveyed by a conveying unit, and detects any uplift amount of a recording medium. When the uplift amount is detected to be a predetermined threshold value or greater, conveying of the recording medium is stopped, and/or the liquid droplet jetting heads are separated from the recording medium.

However, in the configuration of JP-A No. 2010-76872, when a temperature difference arises between the temperature at the periphery of the uplift amount detection unit and the temperature at the periphery of the liquid droplet jetting heads, resulting in a temperature gradient in the vertical direction with respect to the recording medium conveying direction, the light beam projected by the uplift amount detection unit is bent such that the light cannot be accurately received (the received light amount is attenuated) and an uplift amount is detected as being higher than the actual uplift amount. If, in such cases, the detected uplift amount is employed unaltered in determination of whether or not the uplift amount is a threshold value or greater, then sometimes a concern arises that conveying of the recording medium will be stopped or the liquid droplet jetting heads will be separated from the recording medium even though the actual uplift amount has not in fact exceeded the threshold value.

SUMMARY

In consideration of the above circumstances, the present invention provides an image forming apparatus capable of appropriately preventing contact between a liquid droplet jetting head and a recording medium even when a temperature difference arises between the temperature at the periphery of the uplift amount detection unit and the temperature at the periphery of the liquid droplet jetting head.

An image forming apparatus according to a first aspect of the present invention includes: a conveying unit that conveys a recording medium; liquid droplet jetting head that jets liquid droplets onto the recording medium conveyed by the conveying unit; an uplift amount detection unit that detects an uplift amount of the recording medium; a control unit that lowers the conveying speed of the conveying unit or separates the liquid droplet jetting head from the conveying unit when the uplift amount detected by the uplift amount detection unit is a threshold value or greater; a temperature detection unit that detects temperatures; and a correcting unit that corrects the threshold value or the uplift amount. The uplift amount detection unit is provided at the recording medium conveying direction upstream side of the liquid droplet jetting head, projects and receives light along the conveying unit, and detects the uplift amount of the recording medium. The correcting unit corrects the threshold value or the uplift amount based on the temperature difference between a temperature detected by the temperature detection unit at the periphery of the uplift amount detection unit and a temperature detected by the temperature detection unit at the periphery of the liquid droplet jetting heads.

According to such a configuration, contact between the liquid droplet jetting head and the recording medium can be prevented due to the control unit lowering the conveying speed of the conveying unit and/or separating the liquid droplet jetting head from the conveying unit when the uplift amount detected by the uplift amount detection unit is a threshold value or greater.

Then, when a temperature difference arises between the temperature detected at the periphery of the uplift amount detection unit and the temperature at the periphery of the liquid droplet jetting head, namely when a temperature gradient has occurred in the vertical direction with respect to the recording medium conveying direction, the correcting unit corrects the threshold value or the uplift amount based on the temperature difference. Namely, sometimes the beam of light projected by the uplift amount detection unit is bent by the temperature difference, such that light from the beam cannot be accurately received and a higher uplift amount is detected than is actually the case. In such cases the correcting unit corrects the detected uplift amount to the actual uplift amount, or corrects the threshold value. Accordingly, appropriate prevention of contact between the liquid droplet jetting head and the recording medium can be performed even when a temperature difference arises between the temperature at the periphery of the uplift amount detection unit and the temperature at the periphery of the liquid droplet jetting head.

The processing time is sped up when the correcting unit corrects the threshold value rather than the uplift amount. Namely, since the threshold value that acts as a reference needs only be corrected once, rather than performing successive corrections of the uplift amounts detected by the uplift amount detection unit, processing can be shortened, speeding up processing time.

Reference above to "lowering the conveying speed" includes halting conveying in the conveying unit.

Reference above to "along the conveying unit" does not only include projecting light across the width direction of the recording medium, but also includes cases in which light is projected across the conveying direction of the recording medium and cases in which light is projected diagonally.

An image forming apparatus according to a second aspect of the present invention is the image forming apparatus according to the first aspect, wherein the uplift amount detection unit includes a light projection section that projects light across the width direction of the recording medium orthogonally to the conveying direction, and a light reception section that receives light projected by the light projection section and outputs a signal according to the received light amount. The correcting unit may be configured so as to change the correction amount of the threshold value or the uplift amount based on the straight line separation distance from the light projection section to the light reception section.

The amount of optical axis displacement, due to temperature difference between the temperature at the periphery of the uplift amount detection unit and the temperature at the periphery of the liquid droplet jetting head, differs depending on the straight line separation distance between the light projection section and the light reception section (the amount of optical axis displacement increases as the straight line separation distance gets longer). When the optical axis displacement amount is different, the light amount received by the light reception section also differs. According to the configuration of the second aspect, accurate correct can be performed since the correction amount of the threshold value or the uplift amount is changed based on the straight line separation distance from the light projection section to the light reception section that are attached to the device.

An image forming apparatus according to a third aspect of the present invention is the second aspect in which the correcting unit may correct the threshold value to a new threshold value hs that is computed as: $hs=hs_0+\Delta T\times A\times(L1/L0)$, wherein $\Delta T=|T1-T2|$, the temperature difference between temperature T1 (° C.) at the periphery of the uplift amount detection unit and the temperature T2 (° C.) at the periphery of the liquid droplet jetting head, $hs_0$ (mm) is the threshold value when $\Delta T=0$, L0 (mm) is a reference separation distance from the light projection section to the light reception section, L1 (mm) is the straight line separation distance from the light projection section to the light reception section, and A (mm/° C.) is a correction coefficient determined based on the optical axis displacement for a temperature difference of 1° C.

According to such a configuration, by pre-measuring and taking as fixed values the threshold value $hs_0$ (mm) when $\Delta T=0$, the reference separation distance L0 (mm), the straight line separation distance L1 (mm) and the correction coefficient A (mm/° C.) which is determined based on the optical axis displacement caused by the temperature difference, accurate correction can be performed of the threshold value by subsequently employing these fixed values and substituting the temperature difference $\Delta T$ in the above relationship equation.

An image forming apparatus according to a fourth aspect of the present invention is the third aspect wherein the temperature T1 (° C.) at the periphery of the uplift amount detection unit may be an average value of temperatures detected by the temperature detection unit when plural sheets of the recording medium have been conveyed by the conveying unit.

According to such a configuration, since it is sufficient to make a correction, such as of the threshold value, one time only based on the temperature difference between the average value and the temperature at the periphery of the liquid droplet jetting head, the requirement to perform multiple corrections, such as of the threshold value, is eliminated.

An image forming apparatus according to a fifth aspect of the present invention is any one of the first aspect to the fourth aspect wherein the conveying unit may be an image rendering drum that is disposed facing the liquid droplet jetting head and conveys the recording medium by the image rendering drum rotating with the recording medium wrapped onto the peripheral face of the image rendering drum; and the temperature detection unit may be disposed inside a passing cylinder adjacent at the conveying direction upstream side of the image rendering drum and detects a temperature of the image rendering drum from inside the passing cylinder as the temperature at the periphery of the uplift amount detection unit.

According to the above configuration, since the temperature detection unit is disposed inside the passing cylinder, there is no need to provide additional space to dispose the temperature detection unit.

An image forming apparatus according to a sixth aspect of the present invention is any one of the first aspect to the fifth aspect wherein configuration may be made to further include a medium restraining unit disposed further to the conveying direction upstream side than the disposed position of the uplift amount detection unit and pressing the recording medium against a medium retaining face of the conveying unit.

Such a configuration enables certain prevention of contact between the liquid droplet jetting head and the recording medium to be achieved even when there is uplift of the recording medium that has passed the medium restraining unit.

An image forming apparatus according to a seventh aspect of the present invention is any one of the first aspect to the sixth aspect wherein the correcting unit may perform correction once at every print job start.

According to the above configuration, although there is some reduction in accuracy compared to successively performing correction in real time, the processing time is speeded up.

EFFECT OF THE PRESENT INVENTION

According to the above described aspects, an image forming apparatus is provided capable of appropriately preventing contact between a liquid droplet jetting head and a recording medium even when a temperature difference arises between a temperature at the periphery of an uplift amount detection unit and the temperature at the periphery of the liquid droplet jetting head.

BRIEF DESCRIPTION OF THE DRAWINGS

Exemplary embodiments of the present invention will be described in detail based on the following figures, wherein:

FIGS. 6A and 6B each is schematic enlargement of a side view of an uplift amount detection sensor illustrated in FIG. 3, wherein FIG. 6A shows behavior of a detection scan beam 400 when a temperature T1 (° C.) at the periphery of the uplift amount detection unit is higher than a temperature T2 (° C.) at the periphery of the liquid droplet jetting head, and FIG. 6B shows behavior of a detection scan beam 400 when the temperature T1 (° C.) is lower than the temperature T2 (° C.);

DETAILED DESCRIPTION OF THE INVENTION

First Exemplary Embodiment

Figure 1:
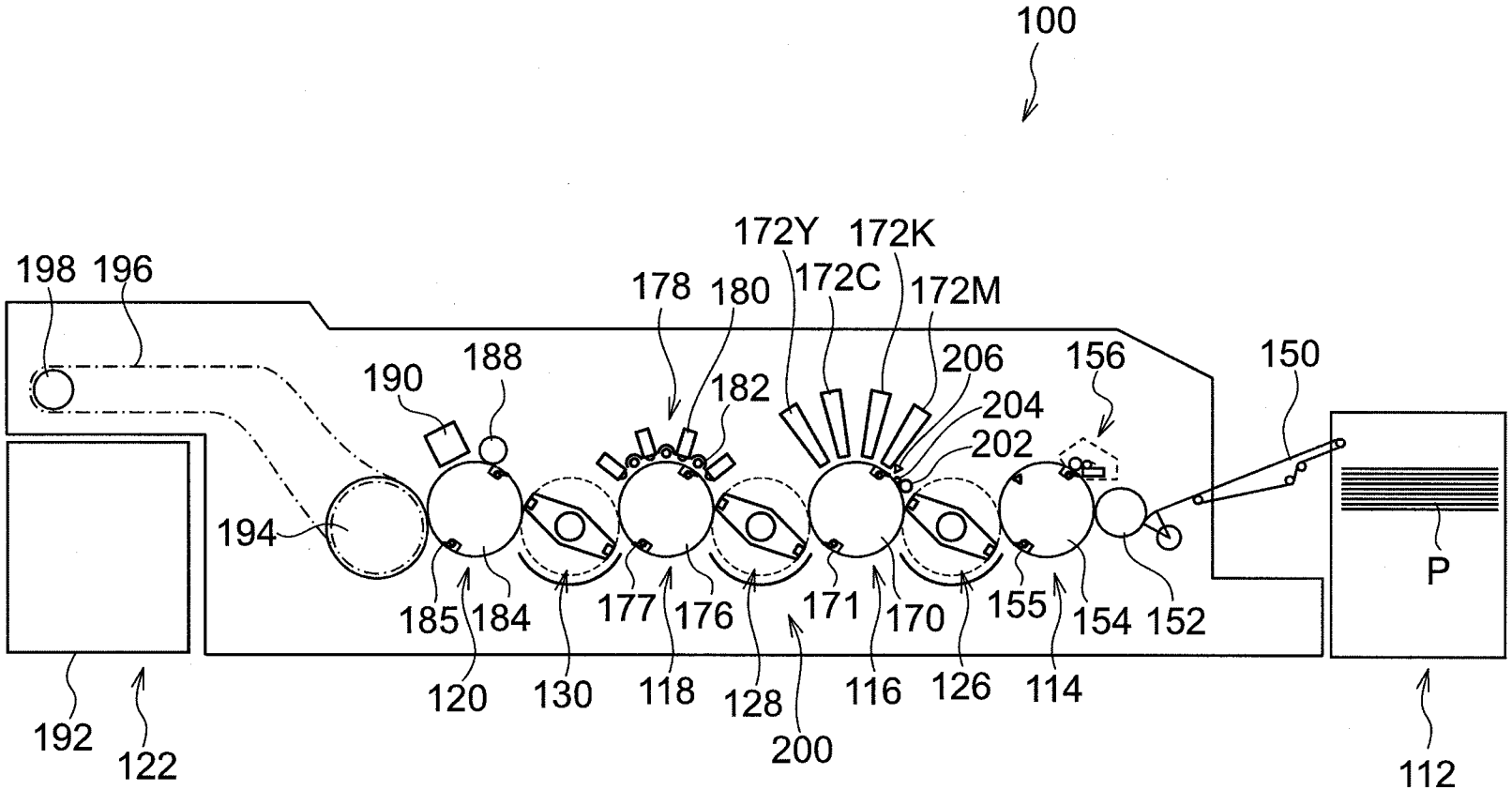
FIG. 1 is a schematic configuration diagram illustrating the overall configuration of an inkjet recording apparatus serving as an example of an image forming apparatus according to a first exemplary embodiment of the present invention.

Specific explanation follows regarding an image forming apparatus according to a first exemplary embodiment of the present invention, with reference to the attached drawings. In the drawings the same reference numerals are applied to members (configuration elements) having the same or corresponding functions to each other, and further explanation thereof is omitted as appropriate.

Overall Configuration

FIG. 1 is a schematic diagram illustrating the overall configuration of an inkjet recording apparatus 100 serving as an example of an image forming apparatus according to the first exemplary embodiment of the present invention.

An inkjet recording apparatus 100 utilizes an impression cylinder direct rendering method to form a desired color image by jetting plural colors of ink from inkjet heads 172M, 172K, 172C, 172Y onto the recording face of a recording medium P retained on an impression cylinder (image rendering drum 170) in an image rendering section 116 (where appropriate the inkjet heads 172M, 172K, 172C, 172Y are collectively referred to below as inkjet heads 172). The inkjet recording apparatus 100 is an on-demand type of image forming apparatus in which a two liquid reaction (aggregation) method is applied for forming images on the recording medium P, by applying a processing liquid (including an aggregation agent for causing components in ink compositions to aggregate) onto the recording medium P prior to ink jetting so as to cause the processing liquid to react with the ink.

Namely, as shown in FIG. 1, the inkjet recording apparatus 100 is configured with main sections including a paper feed section 112, a processing liquid application section 114, the image rendering section 116, a drying section 118, a fixing section 120, and a paper discharge section 122.

The paper feed section 112 is a mechanism for supplying the recording medium P into the processing liquid application section 114. The sheet-form recording medium P is stacked in the paper feed section 112. A paper feed tray 150 is provided to the paper feed section 112, and the recording medium P is fed out one sheet at a time from the paper feed tray 150 and into the processing liquid application section 114.

In the inkjet recording apparatus 100 of the first exemplary embodiment, plural types of recording media P with differing paper type and paper size can be used as the recording medium P. A possible mode is one in which plural paper trays (not shown in the drawings) are provided in the paper discharge section 122 for separately stacking each type of recording media, with automatic switching between the plural paper trays for the paper to be fed to the paper feed tray 150. Another possible mode is one in which an operator selects or changes the paper tray as required.

The processing liquid application section 114 is a mechanism for applying a processing liquid to the recording face of the recording medium P. The processing liquid contains an aggregation agent for causing a component (coloring matter) in an ink composition imparted in the image rendering section 116 to aggregate. The processing liquid and the ink make contact with each other whereby an aggregation reaction occurs and separation of coloring matter and solvent in the ink is promoted. Accordingly, high quality image can be formed without bleeding, interference (merging) or color mixing of ink after ink has been ejected on the recording medium P. The processing liquid can be configured with the aggregation agent and additional other components as required. Utilizing the processing liquid together with the ink compositions enables inkjet recording to be performed at higher speeds, to obtain images with excellent high density and resolution (such as reproducibility of fine lines and fine detailed portions) even with high speed recording.

The processing liquid application section 114 includes a paper feed cylinder 152, a processing liquid drum 154 and a processing liquid coating device 156. The processing liquid drum 154 retains the recording medium P and conveys the recording medium P by rotation. The processing liquid drum 154 is equipped with claw shaped retaining members (clippers) 155 on the outer peripheral face of the processing liquid drum 154, such that the leading edge of the recording medium P can be retained by nipping the recording medium P between the claws of the retaining members 155 and the peripheral face of the processing liquid drum 154. Configuration may be made such that suction holes are also provided on the outer peripheral face of the processing liquid drum 154 and connected to a suction mechanism to suction from the suction holes. The recording medium P can thereby be retained in close contact to the peripheral face of the processing liquid drum 154.

The processing liquid coating device 156 is provided at the outside of the processing liquid drum 154, facing towards the peripheral face of the processing liquid drum 154. The recording medium P is applied the processing liquid on the recording face by the processing liquid coating device 156.

The recording medium P to which the processing liquid has been applied by the processing liquid application section 114 is passed across from the processing liquid drum 154 to the image rendering drum 170 of the image rendering section 116 via an intermediate conveying section 126 (a first passing cylinder).

The image rendering section 116 is provided with the image rendering drum 170 and the inkjet heads 172.

Similarly to the processing liquid drum 154, claw shaped retaining members (clippers) 171 are also provided at the outer peripheral face of the image rendering drum 170, retaining and fixing the leading edge of the recording medium P. The outer peripheral face of the image rendering drum 170 is provided with plural suction holes, and the recording medium P is suctioned onto the outer peripheral face of the image rendering drum 170 by negative pressure. Accordingly contact between the recording medium P and the inkjet heads due to paper uplift is avoided, and paper jams are prevented. Image unevenness resulting from variation in the clearance between the recording medium P and the inkjet head is also prevented.

The recording medium P that has been fixed to the image rendering drum 170 in such a manner is conveyed such that the recording face is facing towards the outside, and ink is jetted onto the recording face from the inkjet heads 172.

Each of the inkjet heads 172M, 172K, 172C, 172Y is a recording head for performing full-line inkjet recording, and has a length corresponding to the maximum width of the image forming region on the recording medium P. Nozzles (jetting ports) for ink jetting are disposed in an array of plural nozzle rows on the ink jetting face of each of the inkjet heads 172M, 172K, 172C, 172Y so as to span across the entire width of the image forming region. Each of the inkjet heads 172M, 172K, 172C, 172Y is disposed so as to extend in a direction orthogonal to the recording medium P conveying direction (orthogonal to the image rendering drum 170 rotation direction).

Liquid droplets of corresponding colors of ink are jetted from each of the inkjet heads 172M, 172K, 172C, 172Y towards the recording face of the recording medium P that is closely retained on the image rendering drum 170. The ink is thereby brought into contact with the processing liquid that has been pre-applied to the recording face in the processing liquid application section 114, and coloring matter (pigment) dispersed in the ink is aggregated to form coloring matter aggregated bodies. Such problems as coloring matter run on the recording medium P are thereby prevented, and an image is formed on the recording face of the recording medium P.

Single pass image rendering can be performed on the recording medium P with the image rendering section 116 configured as described above. High speed recording and high speed output are thereby enabled, and productivity can be raised.

The recording medium P formed with an image in the image rendering section 116 is passed from the image rendering drum 170 via an intermediate conveying section 128 (second passing cylinder) across to a drying drum 176 of the drying section 118.

The drying section 118 is a mechanism for drying moisture contained in solvent that has been separated from the ink by the coloring matter aggregation action. As shown in FIG. 1, the drying section 118 is equipped with a drying drum 176 and a solvent drying device 178.

Similarly to the processing liquid drum 154, the outer peripheral face of the drying drum 176 is equipped with claw shaped retaining members (clippers) 177 such that the leading edge of the recording medium P is retained by the retaining members 177. The drum outer peripheral face also has suction holes (not shown in the drawings) and the recording medium P can be adhered to the drying drum 176 by negative pressure.

The solvent drying device 178 is configured by a combination of plural IR heaters 180 and hot air nozzles 182 disposed at positions facing the outer peripheral face of the drying drum 176. Various drying conditions can be achieved by appropriate adjustments to the temperature and flow rate of hot air blown onto the recording medium P from the hot air nozzles 182. The recording medium P is conveyed adhered and constrained by suction to the outer peripheral face of the drying drum 176 with the recording face facing towards the outside, and the IR heaters 180 and the hot air nozzles 182 dry the recording face of the recording medium P.

The outer peripheral face of the drying drum 176 is provided with the suction holes, and a suction unit is provided to the drying drum 176 for performing suction from the suction holes. The recording medium P can thereby be retained in close contact to the outer peripheral face of the drying drum 176. The recording medium P can also be constrained on the drying drum 176 by negative pressure suction, enabling deformation (curl) of the recording medium P to be prevented.

The recording medium P that has been subjected to drying processing in the drying section 118 is passed across from the drying drum 176 to a fixing drum 184 in the fixing section 120 via an intermediate conveying section 130 (third passing cylinder).

The fixing section 120 is configured including the fixing drum 184, a press roller 188 (flattening unit) and an in-line sensor 190. Similarly to the processing liquid drum 154, the outer peripheral face of the fixing drum 184 is equipped with claw shaped retaining members (clippers) 185 such that the leading edge of the recording medium P can be retained by the retaining members 185.

The recording medium P is conveyed by rotation of the fixing drum 184 such that the recording face faces towards the outside, with the recording face being subjected to flattening processing and the ink being fixed by the press roller 188.

The press roller 188 is for flattening the recording medium P by pressing the recording medium P whose ink has been dried. The in-line sensor 190 is a measuring instrument for detecting a check pattern on the recording medium P and measuring such factors as the moisture content, surface temperature and glossiness, and, for example, a CCD line sensor may be suitably applied as the in-line sensor 190.

The paper discharge section 122 is provided so as to follow on from the fixing section 120. A paper discharge unit 192 is installed in the paper discharge section 122. A fourth passing cylinder 194 and a conveying chain 196 are provided in the space from the fixing drum 184 of the fixing section 120 up to the paper discharge unit 192. The conveying chain 196 is entrained around a tensioning roller 198. The recording medium P that has passed the fixing drum 184 is conveyed via the fourth passing cylinder 194 to the conveying chain 196 and passed across from the conveying chain 196 to the paper discharge unit 192.

While not illustrated in FIG. 1, in addition to the configuration described above, the inkjet recording apparatus 100 of the present exemplary embodiment is also provided with ink storage/filling sections for supplying ink to each of the inkjet heads 172M, 172K, 172C, 172Y and a mechanism for supplying processing liquid to the processing liquid application section 114. In addition a head maintenance section is provided for cleaning each of the inkjet heads 172M, 172K, 172C, 172Y (such as subjecting the nozzle face to wiping, purging, nozzle suctioning), a position detection sensor is provided for detecting the position of the recording medium P on the paper conveying path, and temperature sensors are also provided for detecting the temperature of each apparatus section.

In the configuration of the inkjet recording apparatus 100 described above, a recording medium conveying device 200 of the first exemplary embodiment of the present invention is configured by such members as the processing liquid drum 154, the image rendering drum 170, the drying drum 176, the fixing drum 184, and the intermediate conveying sections 126, 128, 130 disposed therebetween.

Details Regarding the Recording Medium Conveying Device 200

Figure 2:
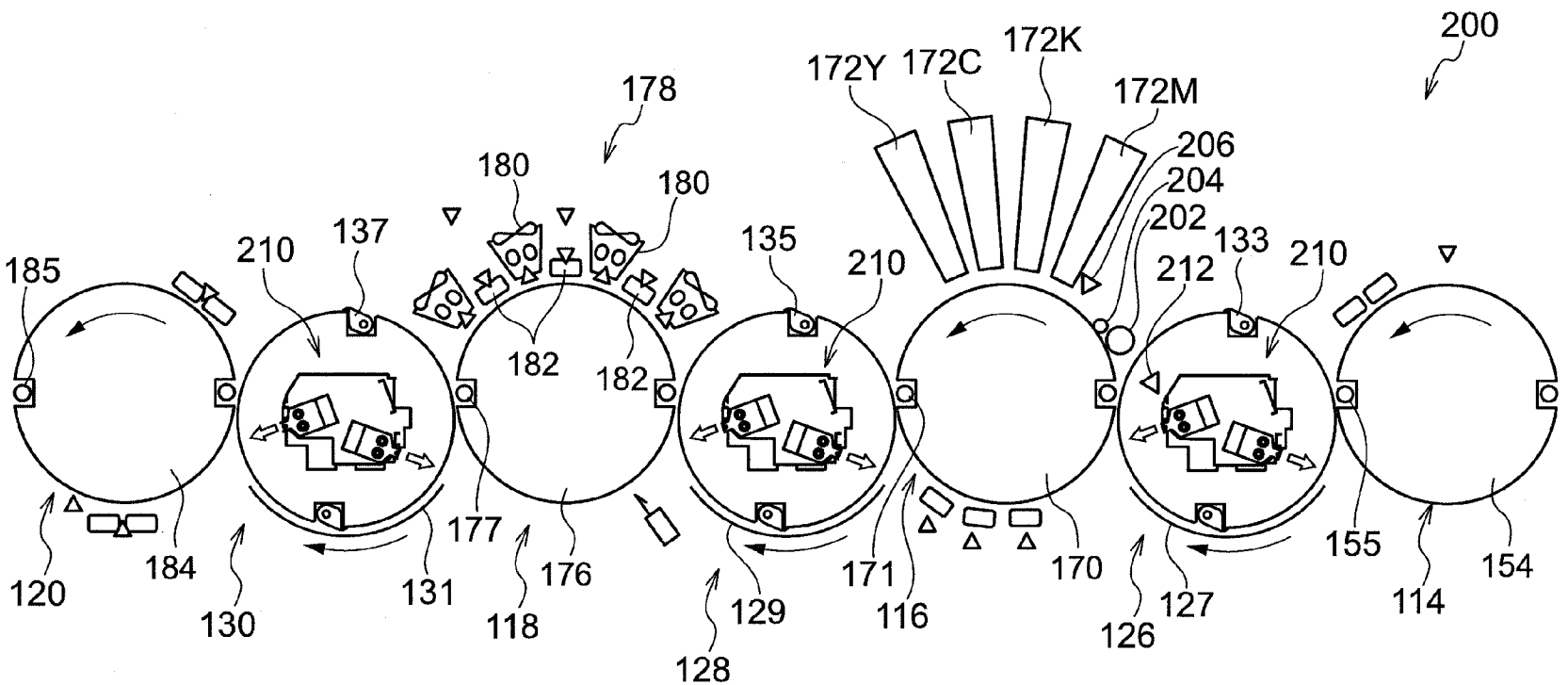
FIG. 2 is an enlarged diagram of a recording medium conveying device that is a main portion of an inkjet recording apparatus of the first exemplary embodiment of the present invention.

FIG. 2 illustrates an enlargement of the recording medium conveying device 200 that is a main portion of the inkjet recording apparatus 100 of the first exemplary embodiment. More detailed explanation follows regarding the recording medium conveying device 200 of the first exemplary embodiment, and in particular regarding the vicinity of the image rendering drum 170.

As shown in FIG. 2, in the recording medium conveying device 200, the processing liquid drum 154, the intermediate conveying section 126 (first passing cylinder), the image rendering drum 170, the intermediate conveying section 128 (second passing cylinder), the drying drum 176, the intermediate conveying section 130 (third passing cylinder) and the fixing drum 184 are disposed in a line. The recording medium P is conveyed by the respective drums thereof, and sequentially, while conveying the recording medium P, a processing liquid is applied, and an image is rendered, dried, and fixed (cured).

A medium restraining roller 202 is provided above the image rendering drum 170 and at the recording medium P conveying direction upstream side of the inkjet heads 172. The medium restraining roller 202 presses the recording medium P towards the medium retaining face of the image rendering drum 170 in order to take out any creases in the recording medium P being conveyed on the image rendering drum 170.

As a special configuration feature of the present exemplary embodiment, an uplift amount detection sensor 204 is provided on the outer peripheral face of the image rendering drum 170, between the medium restraining roller 202 and the inkjet heads 172. The uplift amount detection sensor 204 detects the amount of lifting up of the conveyed recording medium P from the image rendering drum 170. Specifically, the uplift amount detection sensor 204 is set such that a separation distance between the uplift amount detection sensor 204 and the inkjet heads 172 (more specifically the inkjet head 172M) becomes longer than a braking distance of paper conveying. Note that "lifting up" is a term that does not only include lifting up of the recording medium P, but is a general term for uplift of the recording medium P away from the image rendering drum 170 caused by such factors as being forced up due to folding of the recording medium P or due to adhering foreign objects. An uplift amount at each location of the recording medium P is successively detected by the uplift amount detection sensor 204 and the maximum value of the uplift amount may be employed as the "uplift amount". The "uplift amount" may be determined with reference to any of: the separation distance from the image rendering drum 170 to the recording medium P; the separation distance from the recording medium P to the uplift amount detection sensor 204; or the separation distance from the recording medium P to the inkjet heads 172.

There are no particular limitations to the type of the uplift amount detection sensor 204 as long as it is a sensor that projects light along the image rendering drum 170, and a general purpose optical sensor may be employed therefor. For example, configuration can be made so as to emit light from one direction that is received at the opposite side, or a reflecting face may be placed at the opposite side and reflected light is received, such that the uplift of the paper (recording medium P) is detected by the manner in which light is blocked. In the first exemplary embodiment, explanation is of the uplift amount detection sensor 204 described above in which light is emitted from one direction and an optical sensor receives light at the opposite side.

A temperature sensor 206 is provided further to the inkjet head 172 side than the uplift amount detection sensor 204. The temperature sensor 206 is specifically attached at the recording medium P conveying direction upstream end of the inkjet heads 172 and detects the temperature at the periphery of the inkjet heads 172.

Explanation next follows regarding each of the passing cylinders 126, 128, 130. Each of the passing cylinders 126, 128, 130 is equipped with respective ribbed guide members 127, 129, 131. The retaining claws 133, 135, 137 are provided at the leading end portion of arms extending at locations which is 180 degrees on the opposite side of the rotation axis to the guide members 127, 129, 131, grasp the leading edge of the recording medium P and rotate about the rotation axis. The trailing edge portion of the recording medium P is in a free state, and configuration is made such that the recording medium P is conveyed along the guide members (127, 129, 131) with the reverse face side to the recording face side forming a convex shape (reverse face side facing outwards).

Note that a configuration may be adopted in which each of the passing cylinders 126, 128, 130 employs chain clippers to grip the recording medium P and convey the recording medium P such that the reverse face forms a convex shape.

A drying unit 210 is provided inside each of the passing cylinders 126, 128, 130 to blow hot air onto and dry the recording face (front face) side of the recording medium P that is being conveyed with the recording face (front face) facing inwards. In the first exemplary embodiment, in addition to the drying unit 210, a temperature sensor 212 is also provided specifically further to the recording medium P conveying direction upstream side of the inkjet heads 172 inside the first passing cylinder 126 (intermediate conveying section). The temperature sensor 212 is specifically disposed at the image rendering drum 170 side inside the intermediate conveying section 126 and detects the temperature at the periphery of the above described uplift amount detection sensor 204 (specifically the temperature of the image rendering drum 170 in the present exemplary embodiment). There are no particular limitations to the type of the temperature sensor 212, and for example a radiation temperature gauge may be employed in the present exemplary embodiment.

Details Regarding the Uplift Amount Detection Sensor 204

Detailed explanation follows regarding the uplift amount detection sensor 204.

Figure 3:
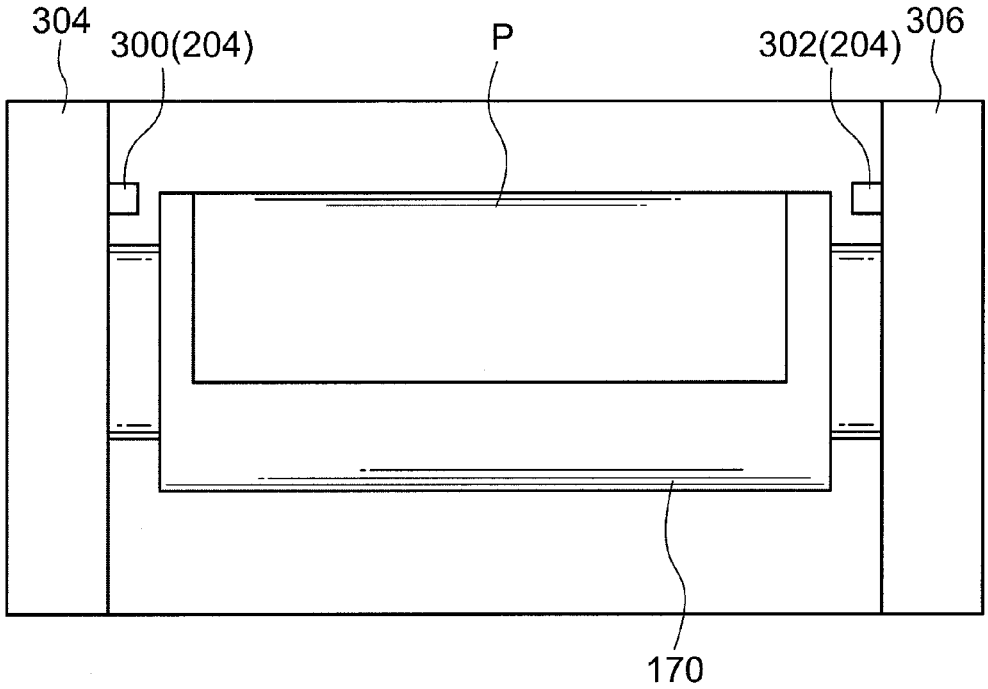
FIG. 3 is a plan view illustrating a configuration of an uplift amount detection sensor.

FIG. 3 is a plan view illustrating a layout configuration of the uplift amount detection sensor 204.

The uplift amount detection sensor 204 is configured as a line sensor with a light projector 300 and a light receptor 302 set. The light projector 300 and the light receptor 302 are disposed on sides in the axial direction of the image rendering drum 170, with the light projector on one side (the left hand side in FIG. 3) and the light receptor on the other side. Configuration is possible with the positional relationship between the light projector 300 and the light receptor 302 reversed. Various light emitting elements, such as an LED or laser, may be employed as the light projector 300. A photoelectric conversion element may be employed as the light receptor 302 for outputting an electrical signal according to the amount of light received.

The optical axis of the scan beam emitted from the light projector 300 is substantially parallel to the axial direction (drum axial direction) of the image rendering drum 170, and a light bundle of the scan beam passes in the vicinity of the surface of the image rendering drum 170 on which the recording medium P (paper) is retained.

In FIG. 3, the reference numerals 304 and 306 denote a support frame for rotatably supporting the image rendering drum 170. The light projector 300 and the light receptor 302 are attached to respective support frame bodies 520 (or 522).

Figure 4:
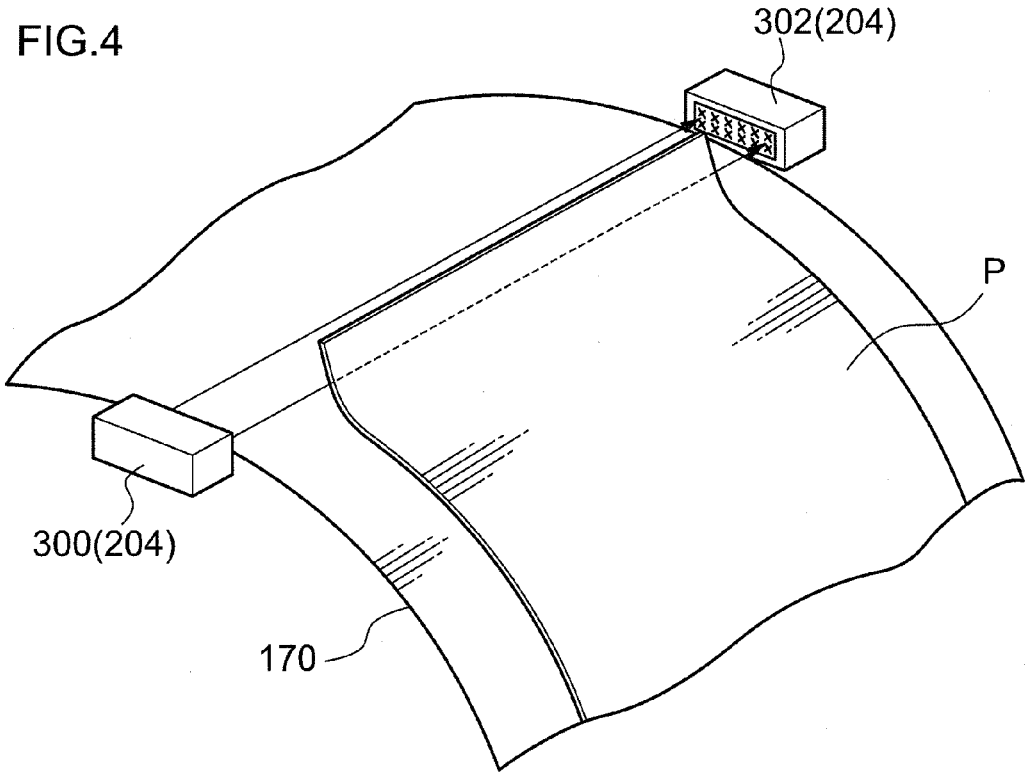
FIG. 4 is a diagram illustrating a manner in which the uplift amount is detected by the uplift amount detection sensor illustrated in FIG. 3.

FIG. 4 is a diagram illustrating the manner in which the uplift amount is detected by the uplift amount detection sensor 204 illustrated in FIG. 3.

As shown in FIG. 4, a portion of the scan beam is blocked by the recording medium P uplift from the image rendering drum 170, and uplift of the recording medium P can be detected from the signal obtained from the light receptor 302 due to the reduction in the amount of incident light (received light amount) on the light receptor 302.

Explanation of Control System

Figure 5:
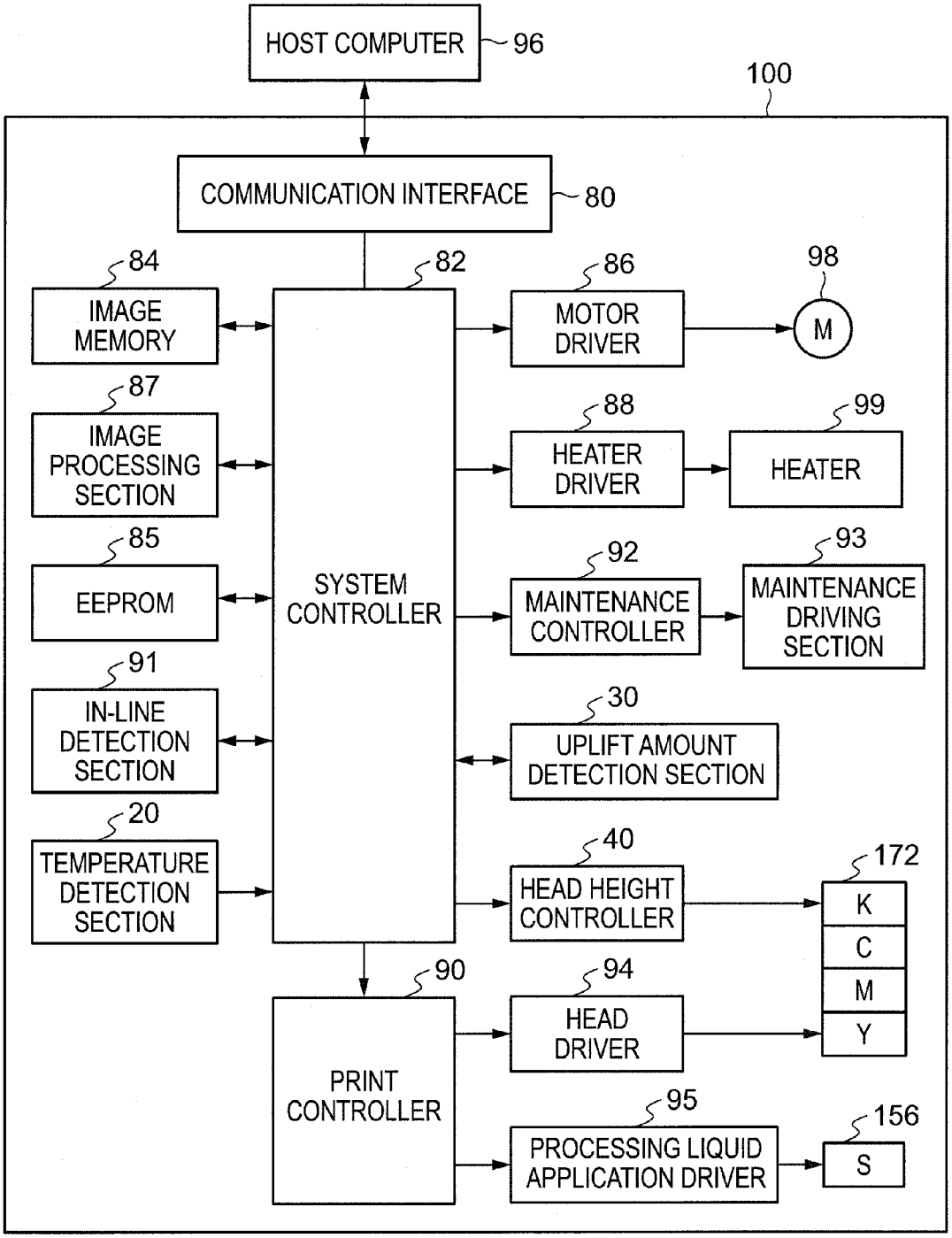
FIG. 5 is a block diagram illustrating relevant portions of a system configuration of the inkjet recording apparatus according to the first exemplary embodiment of the present invention.

FIG. 5 is a block diagram illustrating relevant portions of a system configuration of the inkjet recording apparatus 100 according to the first exemplary embodiment of the present invention.

The inkjet recording apparatus 100 is equipped to include a communication interface 80, a system controller 82, an image memory 84, a motor driver 86, a heater driver 88, a print controller 90, a maintenance controller 92, and a head driver 94.

The communication interface 80 is an interface section for receiving arriving image data sent from a host computer 96. A serial interface such as a Universal Serial Bus (USB), IEEE 1394, Ethernet (registered trademark), wireless network, or a parallel interface such as Centronics can be appropriately employed as the communication interface 80. A buffer memory may be installed in the communication interface 80 in order to enhance the speed of communication. Arriving image data sent from the host computer 96 is input to the inkjet recording apparatus 100 through the communication interface 80, and temporarily stored in the image memory 84.

The image memory 84 is a storage unit for temporarily storing an image that has been input through the communication interface 80, and data reading and writing is performed thereto through the system controller 82. The image memory 84 is not limited to a semiconductor device memory and a magnetic medium such as a hard disk may also be used.

The system controller 82 is configured to include such elements as a Central Processing Unit (CPU) and peripheral circuits. The system controller 82 includes the function of a control device for overall control of the inkjet recording apparatus 100 according to a specific program, and also includes the function of a device for performing various computations. Namely, the system controller 82 controls each section, such as the communication interface 80, the image memory 84, the motor driver 86 and the heater driver 88, and generates a control signal for exchange with the host computer 96 and for controlling a heater 99.

The image memory 84 is stored with program(s) for execution in the CPU of the system controller 82 and with various type of data required for control. The image memory 84 may be configured by a non-rewritable storage unit, or may be configured by a rewritable storage unit such as EEPROM. The image memory 84 is configured as a temporary storage region for image data, and may also be utilized as a program expansion region and as a computation work region for the CPU.

An EEPROM 85 stored with various control programs and an image processing section 87 for subjecting image data to various types of image processing are connected to the system controller 82. In response to instruction from the system controller 82, a control program is read out from the EEPROM 85 and executed. Configuration may be made such that the EEPROM 85 also serves as a storage unit for storing such items as a threshold value, described later, and operation parameters.

The motor driver 86 is for driving a motor 98 under instruction from the system controller 82. In FIG. 5 the motors (actuators) disposed in each respective section of the inkjet recording apparatus 100 are represented in general by reference numeral 98. For example, the motor 98 in FIG. 5 includes such motors as the motors for driving the intermediate conveying sections 126, 128, the paper feed cylinder 152, the processing liquid drum 154, the image rendering drum 170, the drying drum 176 and the fixing drum 184 of FIG. 1.

Further details are given later, however in brief, when the uplift amount of the conveyed recording medium P becomes high, or the uplift amount of the recording medium P becomes high due to a foreign object adhering, there is a concern that the recording medium P might contact the inkjet heads 172 if it were to continue to be conveyed. In such a case, the system controller 82 performs control through the motor driver 86 to stop paper feed and/or conveying of the recording medium P.

The heater driver 88 is for driving the heater 99 under instruction from the system controller 82. Plural heaters provided in the inkjet recording apparatus 100 are represented in general in FIG. 5 by the reference numeral 99. For example, the heater 99 illustrated in FIG. 5 includes such heaters as the heater of the processing liquid application section 114 and the halogen heater of the drying section 118 shown in FIG. 1.

The system controller 82 is also connected to the maintenance controller 92. The maintenance controller 92 controls a maintenance driving section 93 for driving a maintenance unit (not shown in the drawings) including cap and cleaning blade under instruction from the system controller 82.

The print controller 90 has a signal processing function for performing various processing for generating a print control signal from image data in the image memory 84 and processing for performing correction. The print controller 90 also controls a processing liquid application driver 95 prior to printing in order to apply the processing liquid from the processing liquid coating device 156 to the recording medium P, and supply generated print data (dot data) to the head driver 94. In the print controller 90 the desired signal processing is performed, and control is performed based on the image data through the head driver 94 of the jetting liquid droplet amount (jetting amount) and jetting timing for the inkjet heads 172. The desired dot size and dot disposition is accordingly realized.

An in-line detection section 91 performs detection for non jetting to determine nozzles with jetting irregularities based on data obtained from the in-line sensor 190.

When the in-line detection section 91 detects irregular jetting, in cases in which the in-line detection section 91 is able to determine which are the nozzles with jetting irregularities and jetting irregularities are correctable by image correction, a control signal is transmitted to each section through the system controller 82 to implement image correction. However, for cases in which correction cannot be achieved by image correction, a control signal is transmitted to each section through the system controller 82 to perform recovery action, such as preparatory jetting and/or suctioning on the nozzles experiencing jetting irregularities.

The system controller 82 is also connected to a temperature detection section 20, to an uplift amount detection section 30 and to a head height controller 40 according to the present exemplary embodiment.

The temperature detection section 20 is configured by a set of temperature sensors including the above described temperature sensors 206, 212.

The uplift amount detection section 30 is configured to include the uplift amount detection sensor 204 described above and associated control program(s).

The head height controller 40 is for controlling the relative position (height) of the inkjet heads 172 with respect to the surface of the recording medium P being conveyed on the image rendering drum 170. While described in detail later, briefly, for example, when paper uplift occurs with the arriving conveyed recording medium P and there is concern that the recording medium P might make contact with the inkjet heads 172, the head height controller 40 performs control so as to raise the relative height of the inkjet heads 172 with respect to the image rendering drum 170 in order to avoid contact occurring. There are no particular limitations with respect to specific configurations for changing the height of the inkjet heads 172, and a mechanism employing a gear wheel such as of a rack and pinion may, for example, be applied.

Operation

When a print job has started and the recording medium P is being conveyed on the image rendering drum 170, the system controller 82 of the inkjet recording apparatus 100 according to the first exemplary embodiment of the present invention detects the uplift amount of the recording medium P from the uplift amount detection sensor 204 of the uplift amount detection section 30. The system controller 82 then determines whether or not the detected uplift amount is a threshold value, stored for example in the EEPROM 85, or greater. When determined that the detected uplift amount is the threshold value or greater, the system controller 82 lowers the conveying speed (including sometimes stopping conveying) for the recording medium P by using the motor driver 86, or controls the head height controller 40 so as to separate the inkjet heads 172 from the recording medium P.

Figure 6A:
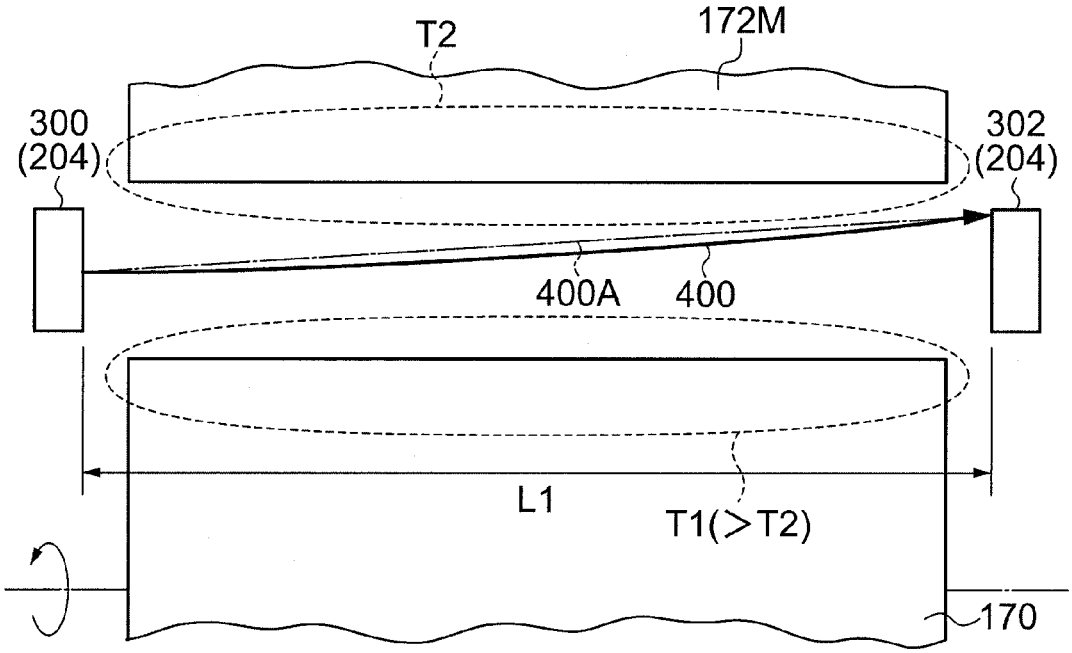
Figure 6B:
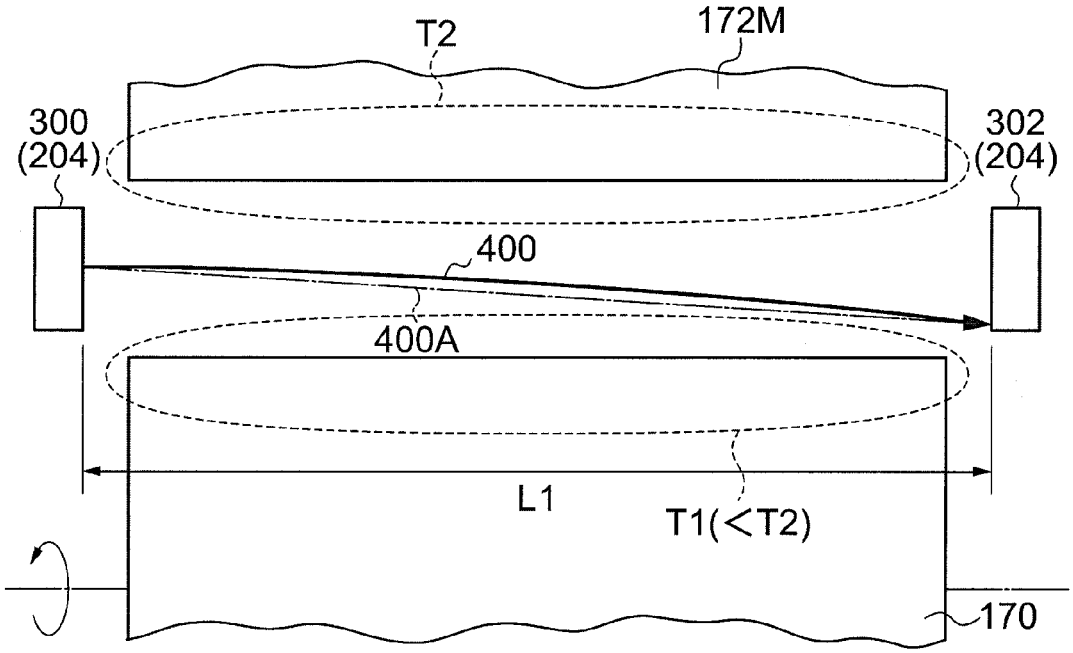
Figure 11:
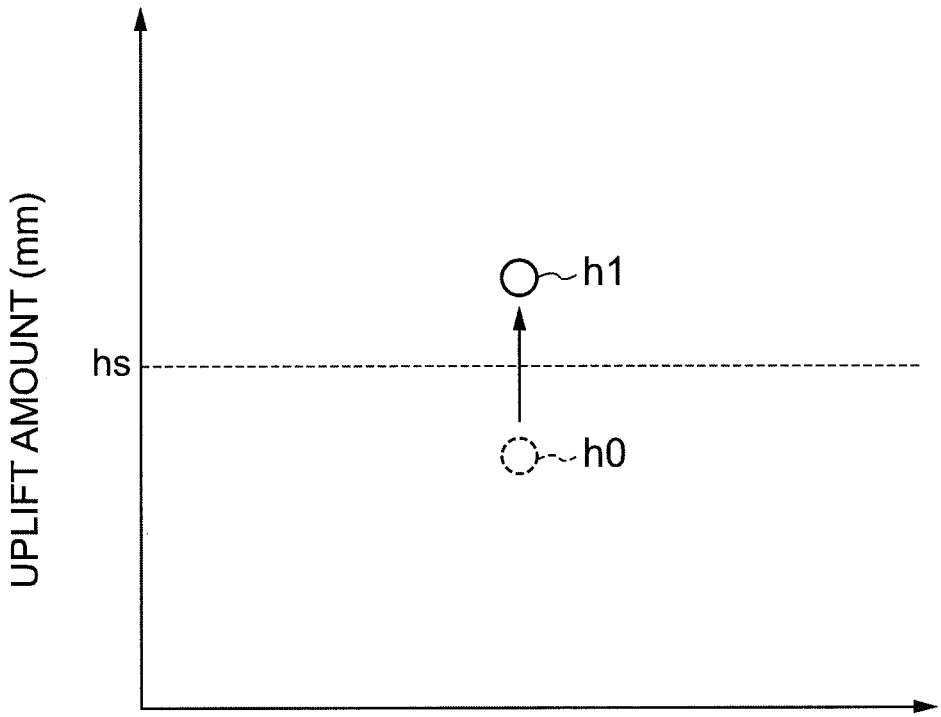
FIG. 11 is a graph illustrating relationship between an uplift amount and a threshold value in a conventional example.

FIGS. 6A and 6B each is a schematic enlargement of a side view of the uplift amount detection sensor 204 illustrated in FIG. 3. FIG. 6A shows behavior of a detection scan beam 400 when a temperature T1 (° C.) at the periphery of the uplift amount detection unit is higher than a temperature T2 (° C.) at the periphery of the liquid droplet jetting head, and FIG. 6B shows behavior of a detection scan beam 400 when the temperature T1 (° C.) is lower than the temperature T2 (° C.). FIG. 11 is a graph illustrating a relationship between the uplift amount and the threshold value in a conventional example.

When a temperature difference arises between the temperature at the periphery of the uplift amount detection sensor 204 and the temperature at the periphery of the inkjet heads 172, giving rise to a temperature gradient in the vertical direction with respect to the recording medium P conveying direction, then, as shown in FIGS. 6A and 6B, a detection scan beam 400 projected by the uplift amount detection sensor 204 (light projector 300) is bent (the optical axis is displaced), resulting in a reduction in the received light amount by the light receptor 302. When this occurs, as shown in FIG. 11, an uplift amount h1 higher than the actual uplift amount h0 is detected based on the reduced received light amount. Namely, the recording medium P is detected as having a greater uplift than is actually the case. For ease of understanding, the displacement in the optical axis in the graph is shown exaggerated from the actual displacement occurring.

As shown in FIG. 11, determination is then made as to whether or not the uplift amount h1 is a threshold value hs or greater while the threshold value hs remains fixed. This determination results that conveying of the recording medium P might be stopped and/or the recording medium P may be separated from the inkjet heads 172 although the actual uplift amount has not actually exceed the threshold value.

Figure 7:
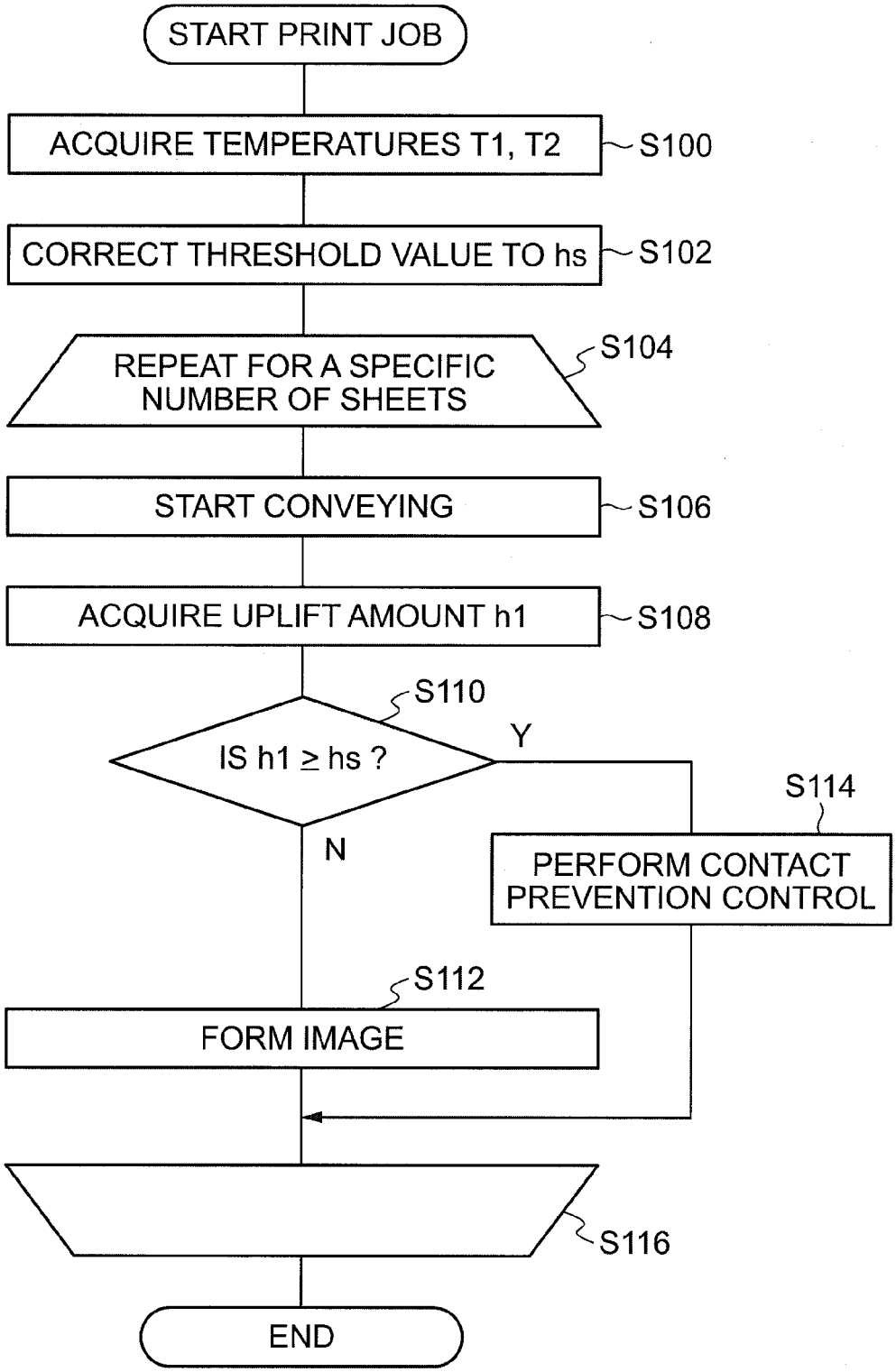
FIG. 7 is a flow chart illustrating an operation sequence of a system controller performed at the start of each print job in the image forming apparatus according to the first exemplary embodiment of the present invention.

Accordingly, the inkjet recording apparatus 100 serving as the image forming apparatus according to the first exemplary embodiment of the present invention is provided with the system controller 82 that serves as a correcting unit for correcting the threshold value hs according the temperature difference between the temperature at the periphery of the uplift amount detection sensor 204 and the temperature at the periphery of the inkjet heads 172. Specifically, explanation follows regarding control of the system controller 82 with reference to the flow chart of FIG. 7. FIG. 7 is a flow chart illustrating an operation sequence of the system controller 82 performed at the start of each print job in the image forming apparatus according to the first exemplary embodiment. In the following the bracketed numbers are step identification numbers in FIG. 7.

Part of the Flow of Processing in the System Controller 82

(S100) The system controller 82 acquires from the temperature sensor 212 of the temperature detection section 20 a temperature T1 (° C.) detected at the periphery of the uplift amount detection sensor 204. The system controller 82 also at the same time acquires from the temperature sensor 206 of the temperature detection section 20 a temperature T2 (° C.) detected at the periphery of the inkjet heads 172.

(S102) The system controller 82 corrects the threshold value hs based on the temperature difference between the temperature at the periphery of the uplift amount detection sensor 204 and the temperature at the periphery of the inkjet heads 172. More specifically, as well as based on the temperature difference the system controller 82 also makes the above correction based on the straight line separation distance between the light projector 300 and the light receptor 302.

Figure 8A:
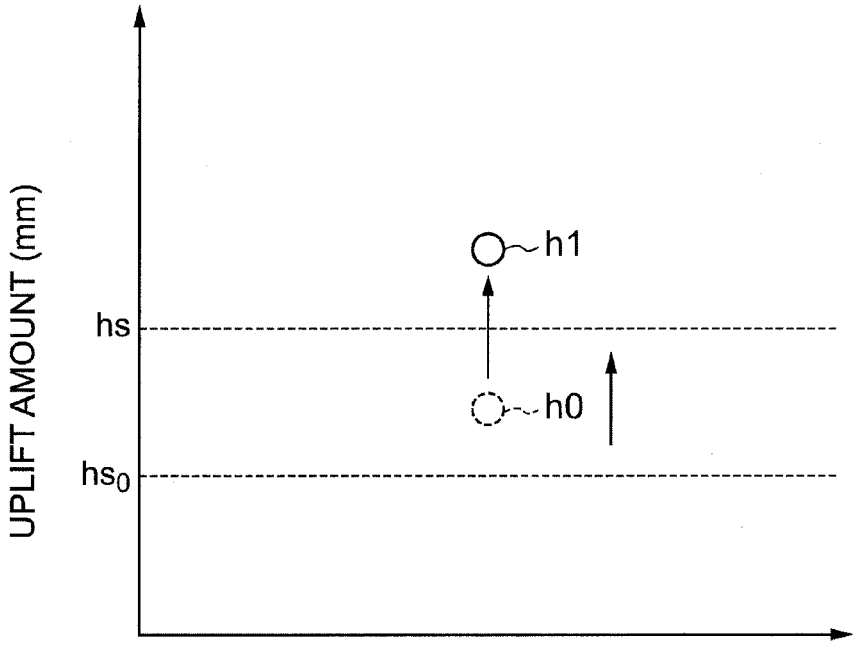
FIG. 8A is a graph illustrating a specific example of a method a system controller employs to correct a threshold value.

FIG. 8A is a graph illustrating a specific example of a method the system controller 82 employs to correct the threshold value hs.

The temperature difference between the temperature T1 (° C.) at the periphery of the uplift amount detection sensor 204 and the temperature T2 (° C.) at the periphery of the inkjet heads 172 is denoted ΔT (° C.)=|T1−T2|, the threshold value when ΔT=0 is denoted $hs_0$ (mm), the reference separation distance from the light projector 300 to the light receptor 302 is denoted L0 (mm), as shown in FIGS. 6A and 6B, the actual straight line separation distance from the light projector 300 to the light receptor 302 is denoted L1 (mm), and a correction coefficient determined based on the pre-measured displacement in the optical axis for a temperature difference of 1° C. is denoted A (mm/° C.). Accordingly, as shown in FIG. 8A, the threshold value is replaced with (corrected to) a new threshold value hs computed by $hs=hs_0+\Delta T\times A\times(L1/L0)$.

The correction coefficient A (mm/° C.) determined based on the optical axis displacement can be pre-set according to a test example described later as, for example, $25\times10^{-3}$ (mm/° C.). The reference separation distance L0 (mm) from the light projector 300 to the light receptor 302 can be preset according to the test example described later as, for example, 860 (mm). The actual straight line separation distance L1 can also be ascertained in advance for each model. The threshold value when ΔT=0 can also employ an initial value of a preset threshold value for the $hs_0$ (mm). Accordingly, the above computation equation can be derived simply by obtaining temperatures T1 and T2 alone. Configuration may be made such that the above A, L0, L1 and $hs_0$ are pre-stored as fixed values in, for example, the EEPROM 85, with capability to change the values as appropriate under instruction from an operation panel, not shown in the drawings, or instruction from the host computer 96. Note that bending (displacement) of the detection scan beam 400 actually has a curved shape as indicated in FIGS. 6A and 6B, but in the above computational formula, the correction coefficient A is determined after the actual shape of the detection scan beam 400 is approximated to be a linear scan beam 400A.

(S104) Processing of step S104 to step S116 is repeatedly performed for the number of print sheets instructed for the print job.

(S106) The system controller 82 then controls the paper feed section 112, feeds the recording medium P from the paper feed tray 150 into the processing liquid application section 114 and starts recording medium P conveying.

(S108) When the recording medium P that has been applied with processing liquid in the processing liquid application section 114 is passed across from the processing liquid drum 154 via the intermediate conveying section 126 to the image rendering drum 170 of the image rendering section 116, and has then passed the medium restraining roller 202 above the image rendering drum 170, the uplift amount h1 of the recording medium P is detected by the uplift amount detection sensor 204 of the uplift amount detection section 30. The system controller 82 acquires the uplift amount h1.

(S110) The system controller 82 determines whether or not the acquired uplift amount h1 is the threshold value hs that has been corrected as described above or greater. When positive determination is made, processing proceeds to step S114, and when negative determination is made processing proceeds to step S112.

(S112) The system controller 82 controls the inkjet heads 172 through the head driver 94 so as to jet ink onto the recording face of the conveyed recording medium P, thereby forming an image thereon.

(S114) The system controller 82 performs control to prevent contact between the inkjet heads 172 and the recording medium P before the recording medium P has been conveyed to the position facing the inkjet heads 172. Specifically, the system controller 82 lowers the conveying speed of the recording medium P through the motor driver 86, such as by halting paper feed and conveying of the recording medium P. Alternatively, configuration may be made such that the system controller 82 raises the height of the inkjet heads 172 with respect to the image rendering drum 170 through the head height controller 40.

Effect

According to the inkjet recording apparatus 100 serving as an example of an image forming apparatus according to the first exemplary embodiment of the present invention, when a temperature difference arises between the temperature T1 at the periphery of the uplift amount detection sensor 204 and the temperature T2 at the periphery of the inkjet heads 172, namely when a temperature gradient occurs in the vertical direction with respect to the recording medium P conveying direction, the system controller 82 serving as a correcting unit corrects a threshold value $hs_0$ to hs based on this temperature difference. Namely, the projected detection scan beam 400 from the uplift amount detection sensor 204 is bent by the temperature difference. However, even though the detection scan beam 400 cannot be accurately received, resulting in an uplift amount h1 being detected that is higher than the actual uplift amount h0, the system controller 82 corrects the threshold value $hs_0$ to a new threshold value hs that matches the higher uplift amount h1. Accordingly, even when a temperature difference occurs between the temperature at the periphery of the uplift amount detection sensor 204 and the temperature at the periphery of the inkjet heads 172, contact between the inkjet heads 172 and the recording medium P can be appropriately prevented.

The optical axis displacement amount due to the temperature difference between the temperature T1 at the periphery of the uplift amount detection sensor 204 and the temperature T2 at the periphery of the inkjet heads 172 differs depending on the straight line separation distance between the light projector 300 and the light receptor 302 (the optical axis displacement amount increases the longer the straight line separation distance is). When the optical axis displacement amount is different, the received light amount of the detection scan beam 400 at the light receptor 302 also differs. However, in the first exemplary embodiment of the present invention, the correction amount of the threshold value or the uplift amount is also changed according to the straight line separation distance from the light projector 300 to the light receptor 302, enabling accurate correction to be performed.

Second Exemplary Embodiment

Explanation follows regarding an image forming apparatus according to a second exemplary embodiment of the present invention.

The image forming apparatus according to the second exemplary embodiment of the present invention is similar in configuration and control to the image forming apparatus according to the first exemplary embodiment, other than in control of the system controller 82.

Figure 9:
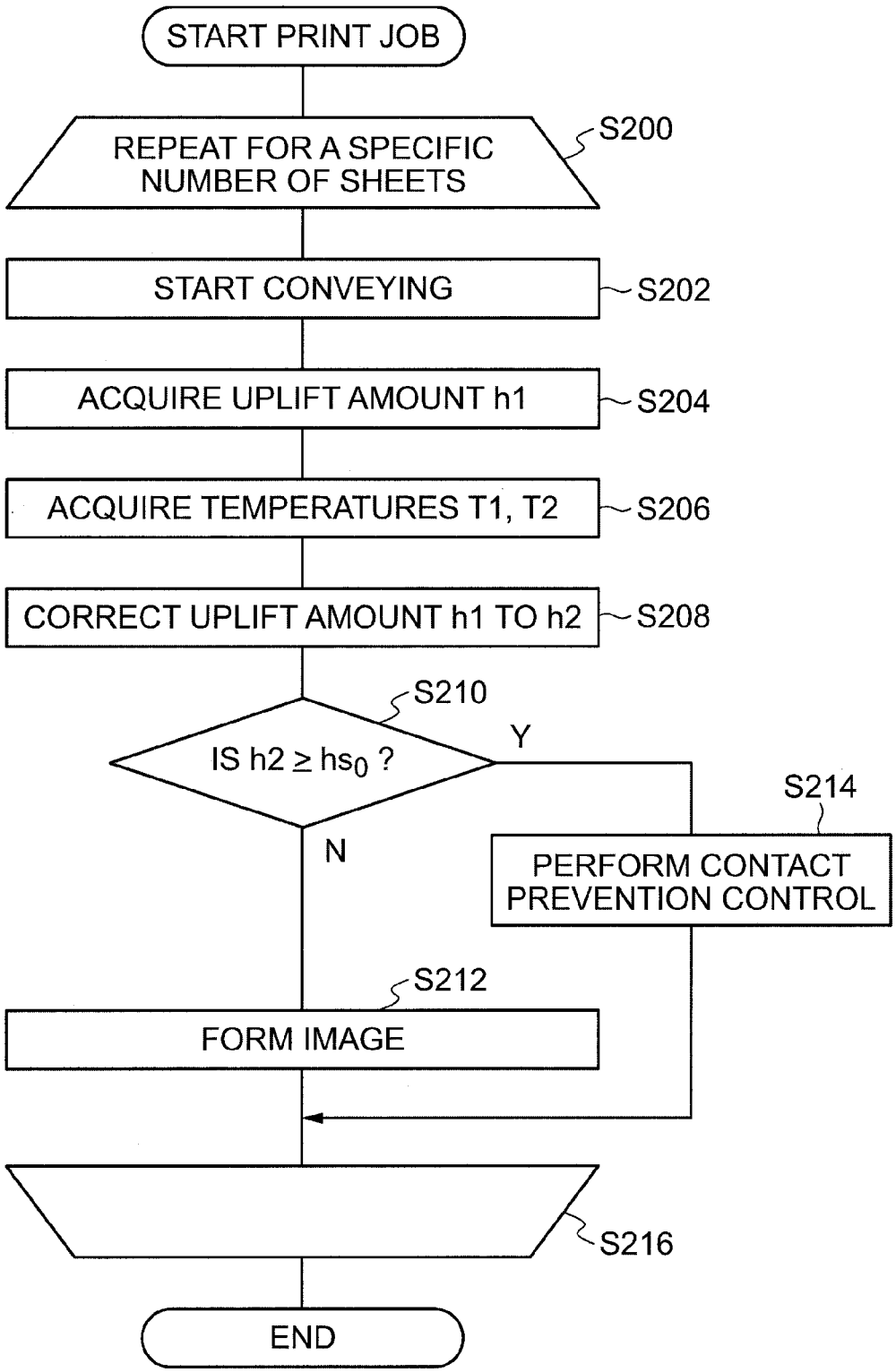
FIG. 9 is a flow chart showing an operation sequence of a system controller performed each time a print job is started in an image forming apparatus according to a second exemplary embodiment of the present invention.

Specifically, explanation follows regarding control of the system controller 82 in an image forming apparatus according to the second exemplary embodiment, with reference to the flow chart of FIG. 9. FIG. 9 is a flow chart showing an operation sequence of the system controller 82 performed each time a print job is started in an image forming apparatus according to the second exemplary embodiment. In the following, the bracketed numbers are step identification numbers in FIG. 9.

Part of Processing Flow in the System Controller 82

(S200) Processing of step S200 to step S216 is repeatedly performed for the number of print sheets instructed for the print job.

(S202) The system controller 82 controls the paper feed section 112, feeds the recording medium P from the paper feed tray 150 into the processing liquid application section 114 and starts recording medium P conveying.

(S204) When the recording medium P that has been applied with processing liquid in the processing liquid application section 114 has passed from the processing liquid drum 154 via the intermediate conveying section 126 to the image rendering drum 170 of the image rendering section 116 and has passed the medium restraining roller 202 above the image rendering drum 170, the uplift amount h1 of the recording medium P is detected by the uplift amount detection sensor 204 of the uplift amount detection section 30. The system controller 82 acquires the uplift amount h1.

(S206) The system controller 82 acquires from the temperature sensor 212 of the temperature detection section 20 a temperature T1 (° C.) detected at the periphery of the uplift amount detection sensor 204. The system controller 82 also at the same time acquires from the temperature sensor 206 of the temperature detection section 20 a temperature T2 (° C.) detected at the periphery of the inkjet heads 172.

(S208) The system controller 82 corrects the acquired uplift amount h1 based on the temperature difference between the temperature at the periphery of the uplift amount detection sensor 204 and the temperature at the periphery of the inkjet heads 172. More specifically, as well as based on the temperature difference correction is also made based on the straight line separation distance between the light projector 300 and the light receptor 302.

Figure 8B:
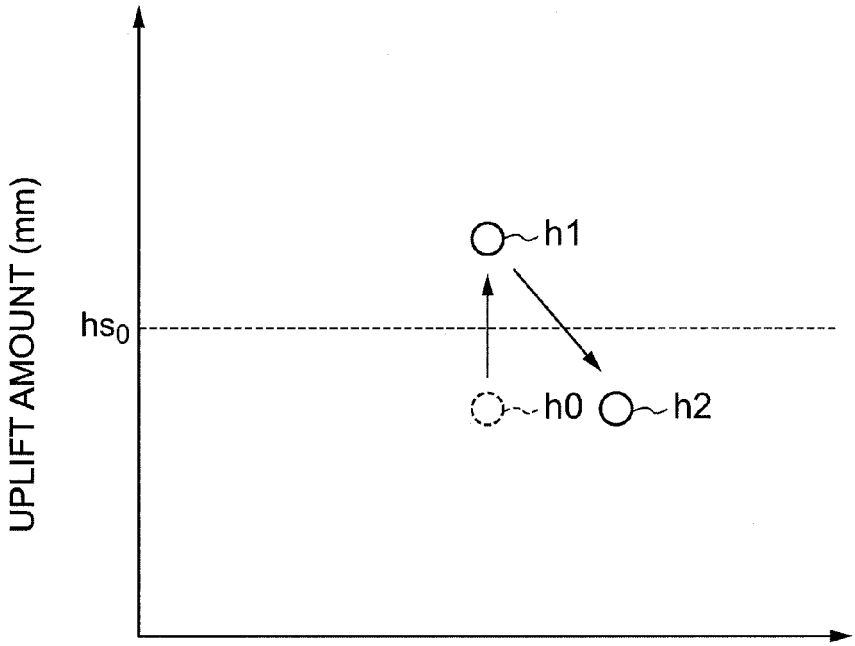
FIG. 8B is a graph illustrating a specific example of a method a system controller employs to correct an uplift amount.

FIG. 8B is a graph illustrating a specific example of a method the system controller 82 employs to correct the uplift amount h1.

The temperature difference between the temperature T1 (° C.) of the uplift amount detection sensor 204 and the temperature T2 (° C.) of the inkjet heads 172 is denoted ΔT (° C.)=|T1−T2|, the reference separation distance from the light projector 300 to the light receptor 302 is denoted L0 (mm), and as shown in FIGS. 6A and 6B, the actual straight line separation distance from the light projector 300 to the light receptor 302 is denoted L1 (mm), and a correction coefficient determined based on the pre-measured displacement in the optical axis for a temperature difference of 1° C. is denoted A (mm/° C.). Accordingly, as shown in FIG. 8B, the acquired uplift amount is changed (corrected) to a new uplift amount h2 computed as h2=h1−ΔT×A×(L1/L0). The correction coefficient A (mm/° C.) which is determined based on the optical axis displacement can be pre-set as, for example, $25\times10^{-3}$ (mm/° C.) as based on a test example described later. The reference separation distance L0 (mm) from the light projector 300 to the light receptor 302 can be preset as, for example, 860 (mm) as based on the test example described later. The actual straight line separation distance L1 can also be ascertained in advance from the model. Accordingly, the above computation equation can be derived simply by obtaining the temperatures T1 and T2 alone.

(S210) The system controller 82 then determines whether or not the uplift amount h2 is the predetermined fixed value threshold value $hs_0$ or greater. Processing proceeds to step S214 when positive determination is made, and processing proceeds to S212 when negative determination is made.

(S212) The system controller 82 controls the inkjet heads 172 through the head driver 94 so as to jet ink onto the recording face of the conveyed recording medium P, thereby forming an image thereon.

(S214) The system controller 82 performs control to prevent contact between the inkjet heads 172 and the recording medium P before the recording medium P has been conveyed to the position facing the inkjet heads 172. Specifically, the system controller 82 lowers the conveying speed of the recording medium P through the motor driver 86, such as halting paper feed and/or conveying of the recording medium P. Alternatively, configuration may be made such that the system controller 82 raises the height of the inkjet heads 172 with respect to the image rendering drum 170 through the head height controller 40.

Effect

According to the inkjet recording apparatus 100 serving as an example of an image forming apparatus according to the second exemplary embodiment of the present invention, when a temperature difference arises between the temperature T1 at the periphery of the uplift amount detection sensor 204 and the temperature T2 at the periphery of the inkjet heads 172, namely when a temperature gradient occurs in the vertical direction with respect to the recording medium P conveying direction, the system controller 82 serving as a correcting unit corrects the acquired uplift amount h1 detected by the uplift amount detection sensor 204 to h0 based on this temperature difference. Namely, the projected detection scan beam 400 from the uplift amount detection sensor 204 is bent due to the temperature difference such that the detection scan beam 400 cannot be accurately received, resulting in an uplift amount h1 being detected that is higher than the actual uplift amount h0. However, the system controller 82 corrects the high-detected uplift amount h1 to the actual uplift amount h0 or a lower h2. Accordingly, even when a temperature difference occurs between the temperature at the periphery of the uplift amount detection sensor 204 and the temperature at the periphery of the inkjet heads 172, the recording medium P can be appropriately prevented from making contact with the inkjet heads 172.

The threshold value is corrected in the first exemplary embodiment, and the uplift amount is corrected in the second exemplary embodiment in order to prevent contact between the inkjet heads 172 and the recording medium P. However, correcting the threshold value, as in the first exemplary embodiment, rather than the uplift amount speeds up processing time. Namely, without successively correcting the uplift amount h1 detected by the uplift amount detection sensor 204, as shown in FIG. 9, since the threshold value $hs_0$ that acts as the reference need only be corrected once, as shown in FIG. 7, processing can be shortened, speeding up processing time.

Examples of Modifications

While the present invention has been explained in detail above by way of particular exemplary embodiments, the present invention is not limited by these exemplary embodiments, and it will be obvious to a person of skill in the art that various other exemplary embodiments are possible within the scope of the present invention. For example, appropriate combinations may be implemented from the above exemplary embodiments. Combinations with the following modification examples may also be implemented.

For example, while explanation is given in the first exemplary embodiment and the second exemplary embodiment of cases in which the threshold value or the uplift amount is corrected based on the straight line separation distance L1 from the light projector 300 to the light receptor 302, configuration may be made such that the threshold value or the uplift amount is corrected based solely on the temperature difference between the temperature at the periphery of the uplift amount detection sensor 204 and the temperature at the periphery of the inkjet heads 172. In such cases the equations for correction become, for example, $hs=hs_0+\Delta T\times A$ and h2=h1−ΔT×A, respectively.

Furthermore, whereas in the first exemplary embodiment at FIG. 7, the threshold value is only corrected a single time at the start of each job, configuration may be made such that real time correction is made when a temperature difference arises between the temperature at the periphery of the uplift amount detection sensor 204 and the temperature at the periphery of the inkjet heads 172.

Furthermore, while explanation has been given of a case in which the temperature at the periphery of the inkjet heads 172 is detected by the temperature sensor 206, a predetermined fixed value may be employed as the temperature at the periphery of the inkjet heads 172. Similarly, a fixed value may be employed for the temperature at the periphery of the uplift amount detection sensor 204, with only one of the temperature at the periphery of the inkjet heads 172 or the temperature at the periphery of the uplift amount detection sensor 204 taken as a fixed value.

While explanation has been given of a case in which the temperature sensor 212 is disposed within the intermediate conveying section 126 at the image rendering drum 170 side, the temperature sensor 212 may be disposed at another location as long as it is a location enabling a temperature at the periphery of the uplift amount detection sensor 204 to be detected. For example, the temperature sensor 212 may be disposed above the image rendering drum 170 at the recording medium P conveying direction upstream side of the medium restraining roller 202, or disposed between the medium restraining roller 202 and the uplift amount detection sensor 204. Similarly, while explanation has been given of a case in which the temperature sensor 206 is attached at the recording medium P conveying direction upstream end of the inkjet heads 172, the temperature sensor 206 may be disposed in another location as long as it is a location enabling a temperature in the vicinity of the inkjet heads 172 to be detected. For example, the temperature sensor 206 may be attached at the recording medium P conveying direction downstream end of the inkjet heads 172. However, measurement is preferably made at the conveying direction upstream end from the perspective of enabling accurate correction of the uplift amount or the threshold value.

Furthermore, when employing the above described corrections, configuration may be made such that the temperature T1 at the periphery of the uplift amount detection sensor 204 is taken as an average value (for example a moving average value) of the temperature detected by the temperature sensor 212 when plural sheets of the recording medium P have been conveyed by the image rendering drum 170. By adopting such an approach, contact between the inkjet heads 172 and the recording medium P can be prevented without performing correction numerous times by performing correction only once, for example of the threshold value, based on the temperature difference between the average value of T1 and the temperature T2 at the periphery of the inkjet heads 172.

Figure 10:
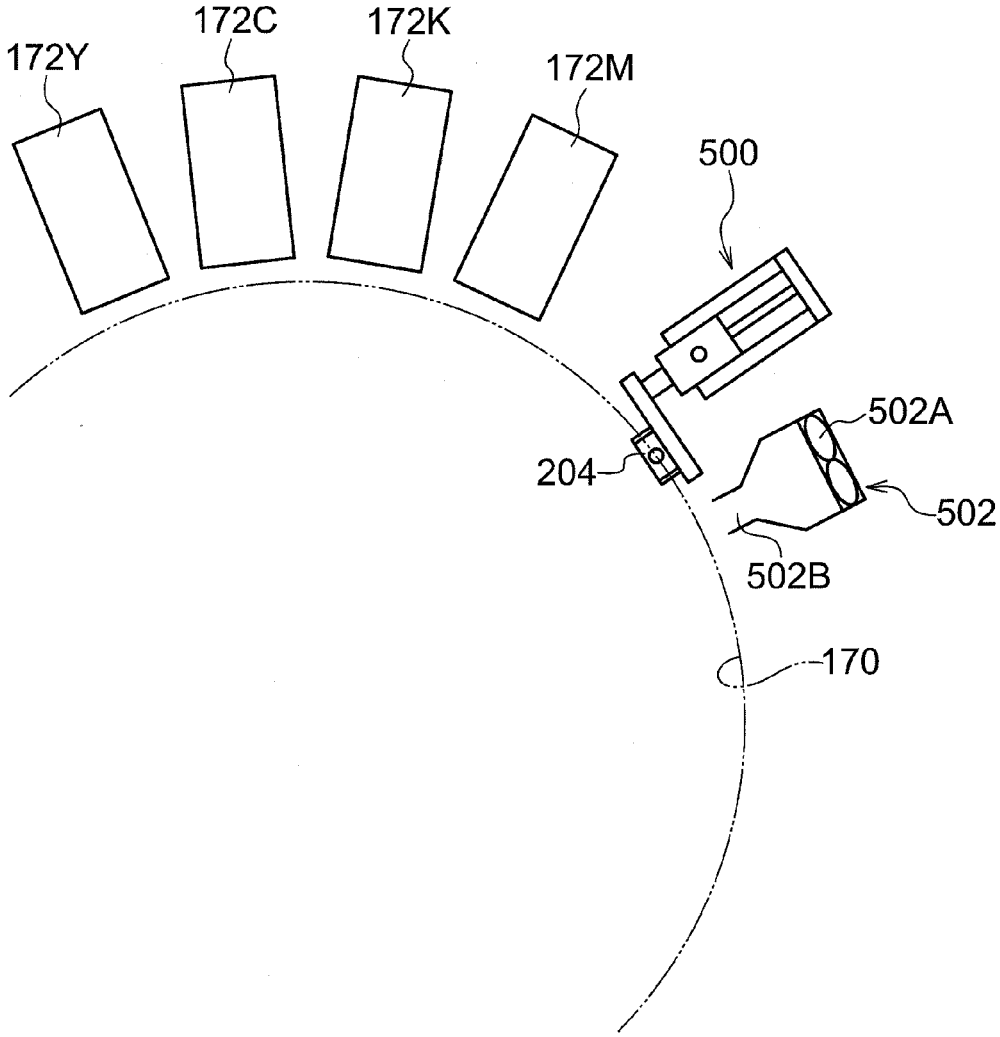
FIG. 10 is a diagram illustrating an example of a configuration above an image rendering drum in a modified example of an image forming apparatus of the first exemplary embodiment.

FIG. 10 is a diagram illustrating a configuration above the image rendering drum 170 in a modified example of the image forming apparatus of the first exemplary embodiment.

As shown in FIG. 10, the uplift amount detection sensor 204 may be attached to an adjusting mechanism 500. The adjusting mechanism 500 is provided with a mechanism capable of adjusting the position of the uplift amount detection sensor 204 in each of the drum axial direction (X axis direction), the drum tangential direction (Y axis direction) and the drum normal direction (Z axis direction), as well as in the rotational direction about the drum axis.

Furthermore, while in the first exemplary embodiment the medium restraining roller 202 is employed as a medium restraining member, configuration may be made, alternatively or in addition thereto, such that air is blown onto the recording medium P so as to make the recording medium P in close contact with the outer peripheral face of the image rendering drum 170. In FIG. 10 a configuration is illustrated in which an air blower device 502 equipped with an air generation section 502A and an ejection nozzle 502B is provided. The air generation section 502A in the present example is configured by plural fans (airflow generating members) disposed in a row along an axial direction of the image rendering drum 170. Airflow is blown from the ejection nozzles 502B onto the entire width direction region of the recording medium P, and the recording medium P is pressed against the face of the image rendering drum 170 by the force of the air.

Furthermore, whereas in the above the system controller 82 changes the threshold value or the uplift amount by employing the above equations $hs=hs_0+\Delta T\times A\times(L1/L0)$ or $h2=h1-\Delta T\times A\times(L1/L0)$, due to the uplift amount detection sensor 204 actually detecting a voltage value, the voltage value detected needs to be converted into a separation distance (mm) representing the uplift amount in order to employ the above equations. However, the present invention may be configured such that the detected voltage value is corrected. When the uplift amount detection sensor 204 detects a variation of a voltage value, the detected variation of the voltage value may be corrected. Further, an electric current value can be corrected or a variation of an electric current value can be corrected in the event that the uplift amount detection sensor 204 detects those values.

Furthermore, while in the above exemplary embodiments sheet-from (cut-paper) is employed as the recording medium P, the present invention is also applicable to a configuration in which continuous paper (a paper roll) is fed and cut to the required size. Furthermore, suction holes may be provided on the outer face of the paper feed tray 150 and connected to a suction unit to perform suction through the holes in order to prevent uplift of the recording medium P. Also, whilst the illustrated processing liquid coating device 156 employs a roller coating method, there is no limitation thereto and, for example, various methods are applicable therefor, such as an inkjet method.

In FIG. 1 a configuration is illustrated with only a single press roller 188, however configuration may be made with plural stages of press rolling according to the image layer thickness and the Tg properties of the latex particles.

While explanation has been given of a case configured with inkjet heads 172 for CMYK standard colors (four colors), ink colors and the number of colors combined are not limited to the present exemplary embodiment. Light color inks, darker color inks, and spot color inks may be added as required. For example, a possible configuration is configured with additional inkjet heads for jetting light colored inks such as light-cyan, light-magenta, and there is no particular limitation to the disposing sequence for the color heads.

While explanation has been given of a case of the inkjet recording apparatus 100 employing an inkjet method using ink as the image forming apparatus in the above exemplary embodiments, there is no limitation to the liquid that is jetting, and application can be made to various types of jetting liquid (liquid droplets) of liquids employing a solvent or dispersion medium that seeps into a recording medium.

While explanation has been given of a case in which an impression cylinder method is employed as the conveying method in the inkjet recording apparatus 100, a belt conveying method maybe employed.

Furthermore, while explanation has been given of a case in which the system controller 82 serves both as the correcting unit and the control unit of the present invention, the correcting unit and control unit may be configured as separate units.

Test Examples

Explanation follows regarding test examples, however the present invention is not limited by these test examples.

A specific model is employed from out of the image forming apparatuses of the configurations described above, and a relationship is derived, between the temperature difference between the temperature at the periphery of the uplift amount detection sensor 204 and the temperature at the periphery of the inkjet heads 172 and the uplift amount when a threshold value is exceeded.

More specifically, pieces of 50 μm tape are stuck one on top of each other on the image rendering drum 170, and the height of the stuck tape (corresponding to uplift amount, referred to below as detection height) at which the system controller 82 determines the threshold value (at a voltage value of 350 mV) is measured for separate temperature differences. Note that for the measurements the temperature T1 at the periphery of the uplift amount detection sensor 204 is taken as the temperature of the image rendering drum 170, and measurements are taken while gradually raising the temperature of the image rendering drum 170.

Table 1 shows measurement results of detection height measured for separate temperature differences.

TABLE 1

| T1 (° C.) | T2 (° C.) | ΔT | Detection Height (mm) |
|---|---|---|---|
| 25 | 25 | 0 | 0.65 |
| 27 | 25 | 2 | 0.6 |
| 29 | 25 | 4 | 0.55 |
| 31 | 25 | 6 | 0.5 |

It can be seen from the results shown in Table 1 that the detection height reduces as the temperature difference increases. This may be attributed that the optical axis is displaced due to the temperature difference as has been explained above. It can be seen that a height reduction detected according to the optical axis displacement for 1° C. of temperature difference is $2.5\times10^{-3}$ (mm/° C.). Accordingly, in the present example, it is preferable to set the correction coefficient A at $2.5\times10^{-3}$ (mm/° C.). The straight line separation distance from the light projector 300 to the light receptor 302 (corresponding to the reference separation distance L0 from the light projector 300 to the light receptor 302) can be taken as being the same as the drum width at 860 mm.

The values of A and L0 in the test example are only examples thereof, and are different when derived for different models.

What is claimed is:

1. An image forming apparatus comprising:

a conveying unit that conveys a recording medium;

a liquid droplet jetting head that jets liquid droplets onto the recording medium conveyed by the conveying unit;

a uplift amount detection unit that is provided at the recording medium conveying direction upstream side of the liquid droplet jetting head, projects and receives light along the conveying unit, and detects an uplift amount of the recording medium;

a control unit that lowers the conveying speed of the conveying unit or separates the liquid droplet jetting head from the conveying unit when the uplift amount detected by the uplift amount detection unit is a threshold value or greater;

a temperature detection unit that detects temperatures; and a correcting unit that corrects the threshold value or the uplift amount based on the temperature difference between a temperature detected by the temperature detection unit at the periphery of the uplift amount detection unit and a temperature detected by the temperature detection unit at the periphery of the liquid droplet jetting heads.

2. The image forming apparatus of claim 1, wherein the uplift amount detection unit comprises:

a light projection section that projects light across the width direction of the recording medium orthogonally to the conveying direction; and a light reception section that receives light projected by the light projection section and outputs a signal according to the received light amount; wherein, the correcting unit changes a correction amount of the threshold value or the uplift amount based on the straight line separation distance from the light projection section to the light reception section.

3. The image forming apparatus of claim 2, wherein the correcting unit corrects the threshold value to a new threshold value hs that is computed as:

$$hs=hs_0+\Delta T\times A\times(L1/L0);\text{ wherein,}$$

ΔT=|T1−T2|, the temperature difference between temperature T1 (° C.) at the periphery of the uplift amount detection unit and the temperature T2 (° C.) at the periphery of the liquid droplet jetting head, $hs_0$ (mm) is the threshold value when ΔT=0, L0 (mm) is a reference separation distance from the light projection section to the light reception section, L1 (mm) is the straight line separation distance from the light projection section to the light reception section, and A (mm/° C.) is a correction coefficient which is determined based on the optical axis displacement for a temperature difference of 1° C.

4. The image forming apparatus of claim 3, wherein the temperature T1 (° C.) at the periphery of the uplift amount detection unit is an average value of temperatures detected by the temperature detection unit when a plurality of sheets of the recording medium have been conveyed by the conveying unit.

5. The image forming apparatus of claim 1, wherein:

the conveying unit is an image rendering drum that is disposed facing the liquid droplet jetting head and conveys the recording medium by the image rendering drum rotating with the recording medium wrapped onto the peripheral face of the image rendering drum; and the temperature detection unit is disposed inside a passing cylinder adjacent at the conveying direction upstream side of the image rendering drum and detects a temperature of the image rendering drum from inside the passing cylinder as the temperature at the periphery of the uplift amount detection unit.

6. The image forming apparatus of claim 1 further comprising a medium restraining unit disposed further to the conveying direction upstream side than the disposed position of the uplift amount detection unit and pressing the recording medium against a medium retaining face of the conveying unit.

7. The image forming apparatus of claim 1 wherein the correcting unit performs correction once at every print job start.

* * * * *